US012195262B2

(12) United States Patent
Lombard et al.

(10) Patent No.: US 12,195,262 B2
(45) Date of Patent: Jan. 14, 2025

(54) PACKAGING SYSTEM AND METHOD FOR MULTI-COMPONENT PRODUCT PREPARATION PROCESSES

(71) Applicant: Henkel AG & Co. KGaA, Duesseldorf (DE)

(72) Inventors: Antoine Lombard, Duesseldorf (DE); Philippe Blank, Kleve (DE); Angelo Dori, Langenfeld (DE)

(73) Assignee: Henkel AG & Co. KGaA, Düsseldorf (DE)

( * ) Notice: Subject to any disclaimer, the term of this patent is extended or adjusted under 35 U.S.C. 154(b) by 54 days.

(21) Appl. No.: 17/481,236

(22) Filed: Sep. 21, 2021

(65) Prior Publication Data

US 2022/0002065 A1 Jan. 6, 2022

Related U.S. Application Data

(63) Continuation of application No. PCT/EP2020/055524, filed on Mar. 3, 2020.

(30) Foreign Application Priority Data

Mar. 21, 2019 (DE) ..... 102019203855.7

(51) Int. Cl.
*B65D 81/32* (2006.01)
*B65D 51/28* (2006.01)

(52) U.S. Cl.
CPC ..... *B65D 81/3211* (2013.01); *B65D 51/2814* (2013.01)

(58) Field of Classification Search
CPC ..... B65D 51/2814; B65D 51/2842; B65D 51/2807; B65D 81/3211
(Continued)

(56) References Cited

U.S. PATENT DOCUMENTS 5,779,075 A * 7/1998 Salmon ..... B65D 41/3428 215/252
6,135,275 A * 10/2000 Kelders ..... B65D 81/3211 215/DIG. 8
(Continued)

FOREIGN PATENT DOCUMENTS

DE 29721872 U1 1/1998
DE 69709692 T2 9/2002
(Continued)

OTHER PUBLICATIONS

PCT International Search Report PCT/EP2020/055524 Completion Date: May 14, 2020; Mail Date: Jun. 4, 2020 3 pages.

*Primary Examiner* — Steven A. Reynolds
(74) *Attorney, Agent, or Firm* — Blank Rome LLP

(57) ABSTRACT

A packaging system for a multi-component product preparation process, having: a first container for storing a first product preparation component, a second container for storing at least one second product preparation component, and a closure element which seals off the first container from the surroundings and has a coupling device in order to couple the second container to the closure element and in order to establish a fluidic connection between the first container and the second container. The closure element includes a closure cap which can be separated from the closure element along a predetermined breaking point in order to release the fluidic connection between the first container and the second container, wherein the closure cap can be coupled to the second container—so as to be blocked in a rotational direction about an axis of the closure element and movable in a direction parallel to the axis.

20 Claims, 10 Drawing Sheets

(58) Field of Classification Search
USPC ..... 206/219
See application file for complete search history.

(56) References Cited

U.S. PATENT DOCUMENTS

| | | | | |
|---|---|---|---|---|
| 6,655,524 | B2 * | 12/2003 | De Laforcade .... | B65D 81/3211 206/568 |
| 8,226,126 | B2 * | 7/2012 | Johns ..... | F16L 29/005 285/3 |
| 10,369,078 | B2 * | 8/2019 | Bhargava ..... | A61J 1/2093 |
| 11,591,145 | B2 * | 2/2023 | Kim ..... | B65D 51/2878 |
| 2002/0030064 | A1 | 3/2002 | Lacout | |
| 2006/0237095 | A1 * | 10/2006 | Johns ..... | B65D 81/3211 141/100 |
| 2007/0289670 | A1 * | 12/2007 | Johns ..... | B65D 81/3211 141/383 |
| 2009/0057262 | A1 | 3/2009 | Cho | |
| 2014/0224815 | A1 * | 8/2014 | Gallem ..... | A61M 15/0028 220/661 |
| 2016/0311601 | A1 * | 10/2016 | Genchev ..... | B65D 81/3211 |
| 2018/0354703 | A1 * | 12/2018 | McGrath ..... | B65D 81/3211 |
| 2022/0212841 | A1 * | 7/2022 | Den Boer ..... | B05B 11/0056 |
| 2022/0258153 | A1 * | 8/2022 | Caubet Canals ..... | B01L 3/502 |

FOREIGN PATENT DOCUMENTS

| | | | |
|---|---|---|---|
| DE | 69730742 | T2 | 9/2005 |
| EP | 0520207 | A1 | 12/1992 |
| EP | 1167231 | A1 | 1/2002 |
| EP | 2327634 | A1 | 6/2011 |
| EP | 2774874 | A1 | 9/2014 |
| JP | 2006232323 | A | 9/2006 |
| JP | 2012158361 | A | 8/2012 |
| WO | 9851586 | A1 | 11/1998 |
| WO | 2007111667 | A2 | 10/2007 |
| WO | 2007145773 | A2 | 12/2007 |

* cited by examiner

Fig. 11
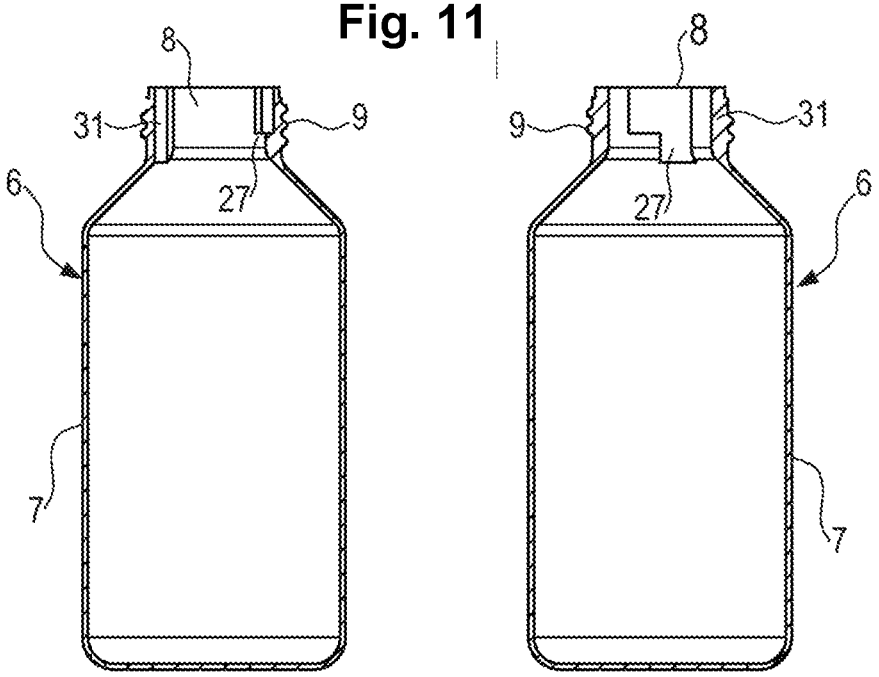
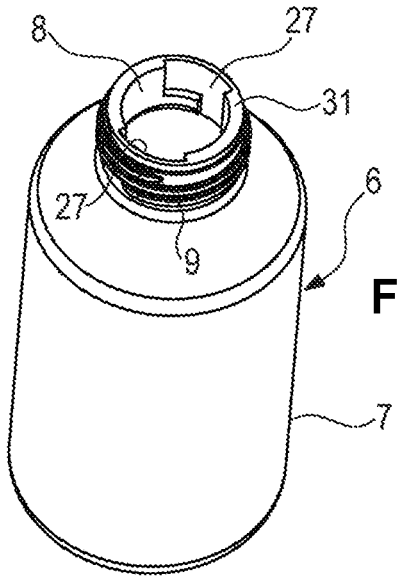
Fig. 12
Fig. 13a
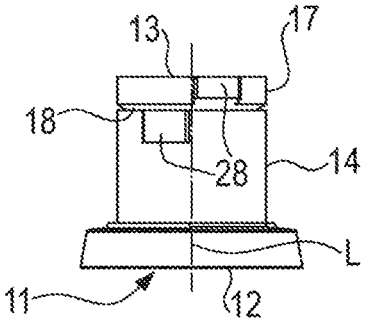
Fig. 13b
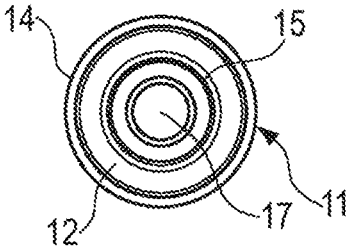
Fig. 13c
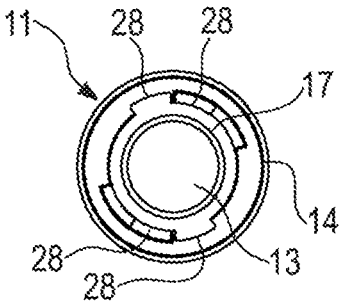

PACKAGING SYSTEM AND METHOD FOR MULTI-COMPONENT PRODUCT PREPARATION PROCESSES

FIELD OF THE INVENTION

The invention relates to a packaging system for a multi-component product preparation process, having a first container for storing a first product preparation component, a second container for storing at least one second product preparation component and a closure element which both seals off the first container from the surroundings and has a coupling device in order to couple the second container to the closure element and in order to establish a fluidic connection between the first container and the second container. Such packaging systems are usually used for the targeted mixing of initially separately stored fluids and are primarily used when using two-component or multi-component product preparations in which the individual preparation components are incompatible due to their chemical composition or should only be mixed shortly before the actual use. Such product preparations are known, inter alia, from the cosmetic and medical fields, and from the food sector and washing and cleaning agents sector.

BACKGROUND OF THE INVENTION

For example, German utility model DE 29721872 U1 describes an arrangement for coupling two containers with the aim of possibly mixing fluids which are initially stored separately in the containers. The coupling arrangement described therein is used, inter alia, for mixing individual components of hair dyes, the individual components being incompatible with one another and therefore having to be stored separately from one another in separate containers until they are actually used. The mixing of the individual components to form the ready-to-use hair dye takes place immediately before use. For this purpose, the coupling arrangement has two coupling elements, each of which makes it possible for an associated container to be connected. The coupling elements each form a flow passage which is in fluidic connection with the relevant container interior. In addition, the two flow passages are aligned with one another within the coupling arrangement. Furthermore, the coupling arrangement has a control element which is arranged in one of the flow passages so as to be movable between a first and a second position. Depending on the relevant position of the control element, the flow passages can be open or closed. In this respect, depending on the position of the control element, a flow through the flow passages and thus the entire coupling arrangement is made possible or prevented. The flow passages are usually closed in the initial state of the coupling arrangement. In this case, in order to improve the sealing function, an additional stopper is provided which closes a flow passage in the initial state of the coupling arrangement. During use, the stopper is removed under the action of the movable control element, so that the flow passages are released for the flow through.

WO 2007/111667 A2 describes a further system having two containers for the separate storage of two container contents, in which the different container content can be mixed immediately before use by means of a coupling means connecting the two containers. For this purpose, the coupling means has a valve arrangement which can be moved between a closed position and an open position. In the open valve position, a flow passage is released in the coupling device, which flow passage forms a fluidic connection between the two containers. This allows the two container contents to be mixed when the valve is in the open position.

Although the systems described above basically allow different substances to be stored separately and to be mixed together immediately before actual use, they have an undesirably complicated structural design. In addition, such systems may also contain hazardous chemical substances which require careful and correct use. In such a case, an undesired mixing or the unintentional escape of the individual substances must be prevented.

BRIEF SUMMARY OF THE INVENTION

On this basis, the problem addressed by the invention is that of providing an adapter-like device for coupling two containers in order to allow the fluids stored separately therein to be mixed, which device, with a simple overall design, allows simple and safe operation and in particular eliminates operating errors as far as possible. Furthermore, a safe method for mixing a multi-component product preparation using such a packaging system is to be specified.

In principle, the term "fluids" in the sense of the invention is understood to mean all flowable and pourable substances, i.e., not only liquid or correspondingly viscous substances but also solid bulk materials such as powders or granules.

The solution to this problem is found in the subject matter of the claims. Further embodiments and advantageous configurations are the subject of the dependent claims.

According to one aspect of the invention, a packaging system for a multi-component product preparation is specified, which has a first container for storing a first product preparation component, a second container for storing at least one second product preparation component and a closure element. The closure element seals off the first container from the surroundings and has a coupling device in order to couple the second container to the closure element and in order to establish a fluidic connection between the first container and the second container. The closure element comprises a closure cap which can be separated from the closure element along a predetermined breaking point in order to release the fluidic connection between the first container and the second container. The closure cap can be coupled to the second container so as to be blocked in a rotational direction about an axis L of the closure element and movable in a direction parallel to the axis L.

The packaging system has the advantage that it can be handled particularly safely and is therefore also suitable for storing and mixing hazardous chemicals. This is achieved in particular by the first container being initially tightly sealed by means of the closure cap. The closure cap can be separated by breaking the predetermined breaking point only when the first container is connected to the second container via the coupling device of the closure cap. The fluid stored in the first container is therefore only released when it can flow into the second container. Since the closure cap is initially tightly connected to the closure element, accidental release of fluid from the first container is largely ruled out.

The predetermined breaking point is designed, for example, as a region of the closure element that has a particularly small wall thickness.

This is further reinforced if the closure element is connected to the first container in a non-detachable manner, excluding by the destruction of said closure element, for example is locked to the first container. It is then not possible to separate the closure element from the first container, for example by twisting it off, and in doing so accidentally release fluid. This greatly reduces the likelihood of operating errors.

According to one embodiment, the closure element and the second container have mutually corresponding threaded portions in order to couple the second container to the closure element by screwing. This is an advantageous option for securely and tightly connecting the second container to the closure element and thus ultimately to the first container.

According to one embodiment, the coupling device is designed as a collar having an internal thread that can be slipped over an edge of an opening of the second container when the first container is coupled to the second container, the internal thread interacting with an external thread of the second container in order to connect the coupling device to the second container.

This embodiment has, inter alia, the advantage that a thread on the edge of the second container, which is also used for a closure element of the second container that is to be removed prior to mixing, can be used for the connection to the closure element. The second container can therefore be designed in a particularly simple manner.

According to an alternative embodiment, the closure element and the second container have mutually corresponding coupling elements which allow a relative rotation of the closure element and the second container in a value range of less than 180°.

This embodiment has the advantage that the closure element can be designed in a particularly simple manner and can be manufactured particularly easily in an injection molding process. For example, the coupling elements on the closure element can be designed as projections which engage in recesses in the container, the dimensions of the recesses being wider than the projections such that the closure element can be rotated with respect to the second container by a certain angle of less than 180°.

The rotatability is in this case used to separate the closure cap from the closure element at the predetermined breaking point. Since the closure cap can be fixed to the second container so as to be blocked in a rotational direction about an axis L of the closure element, rotating the closure element with respect to the second container can result in the closure cap being separated. A rotation of a few degrees may be sufficient for this purpose. In order to ensure easy handling behavior, a relative rotation of, for example, 10° to less than 180°, in particular of 30° to 90°, can be advantageous.

The blocking of the closure cap against rotation about the axis L can be achieved, for example, by the closure cap having at least one projection which, during the coupling with the second container, interacts with at least one corresponding recess or a groove in the second container such that a rotation of the closure cap relative to the second container is blocked. In particular, a plurality of such projections and recesses can be provided, which are arranged so as to be distributed over the circumference of the container or the closure cap. According to one embodiment, the closure cap has a large number of locking teeth in the edge region thereof, which engage in recesses in the second container.

According to one embodiment, the closure cap is covered with respect to the surroundings by means of a cover element in such a way that manual access to the closure cap from the outside is prevented.

In particular, the cover element can be designed as a sleeve-shaped portion of the closure element that radially surrounds the closure cap and projects axially beyond said closure cap.

Such a cover element has the advantage that the closure cap cannot be removed manually. This is a special safeguard which is advantageous when an aggressive substance is stored in the second container. In this case, the sleeve-shaped portion can correspond to the collar mentioned above and have a thread which corresponds to a thread on the second container.

According to one embodiment, an edge region of the sleeve-shaped portion is designed as a tamper-evident ring which breaks into a plurality of portions when the closure element is placed on the second container in such a way that the closure cap is separated from the closure element along the predetermined breaking point thereof. In this embodiment, use is made of the fact that the closure cap and the second container approach one another during the separation of the closure cap. This approach causes the tamper-evident ring to break. From the state of the tamper-evident ring it is thus possible to see whether the closure cap has possibly already been completely or partially separated and the first container is therefore no longer securely closed.

According to one embodiment, the closure element can be coupled to the second container in a liquid-tight manner. For this purpose, said closure in particular has at least one seal in order to ensure a liquid-tight connection to the first and/or second container.

This embodiment has the advantage that the unintentional escape of liquid before, during or after the mixing of the fluids is prevented.

According to one aspect of the invention, a method is specified for mixing a multi-component product preparation using a packaging system having a first container for storing a first product preparation component, a second container for storing at least one second product preparation component and a closure element which seals off the first container from the surroundings and has a coupling device in order to couple the second container to the closure element and to establish a fluidic connection between the first container and the second container, the closure element comprising a closure cap which can be separated from the closure element along a predetermined breaking point.

The method comprises attaching the first container to the second container by means of the closure element, by corresponding threaded portions on the closure element and on the second container being attached to one another to form a screw connection and the closure cap being coupled to the second container so as to be blocked in a rotational direction about an axis L of the closure element.

The method also comprises screwing the closure element to the second container via the corresponding threaded portions and separating the closure cap, which is blocked in the rotational direction, from the closure element at the predetermined breaking point.

The method also comprises further screwing the closure element to the second container while simultaneously moving the separated closure cap into the interior of the container, and mixing the two product components in the first and/or second container using the open fluidic connection between the two containers.

The method is particularly easy to carry out even without practice. In particular, a user of the packaging system coming into contact with components of the product preparation when carrying out the method is largely ruled out.

A further aspect of the invention relates to an alternative method for mixing a multi-component product preparation using a packaging system having a first container for storing a first product preparation component, a second container for storing at least one second product preparation component and a closure element which seals off the first container from the surroundings and has a coupling device in order to couple the second container to the closure element and to establish a fluidic connection between the first container and the second container, the closure element comprising a closure cap which can be separated from the closure element along a predetermined breaking point, the method comprising attaching the first container to the second container by means of the closure element, by corresponding coupling elements on the closure element and on the second container, which allow a relative rotation of the closure element and the second container in a range of values of less than 180°, being brought into engagement and the closure cap being coupled to the second container so as to be blocked in a rotational direction about an axis L of the closure element.

The method also comprises rotating the closure element about the axis L with respect to the second container via the corresponding coupling elements, separating the closure cap, which is blocked in the rotational direction, from the closure element at the predetermined breaking point.

The method further comprises an axial relative movement between the closure element and the second container in order to press the separated closure cap into an interior of the second container, and mixing the two product components in the first and/or second container using the open fluidic connection between the two containers.

BRIEF DESCRIPTION OF THE DRAWINGS

Embodiments of the invention are explained in more detail below with reference to schematic drawings.

FIG. 11 shows two different sectional views of a second container for the packaging system according to the second embodiment;

FIG. 12 is a perspective view of the second container according to FIG. 11;

FIGS. 13*a* to 13*f* are different views of a closure element for the packaging system according to the second embodiment;

DETAILED DESCRIPTION OF THE INVENTION

Figure 1:
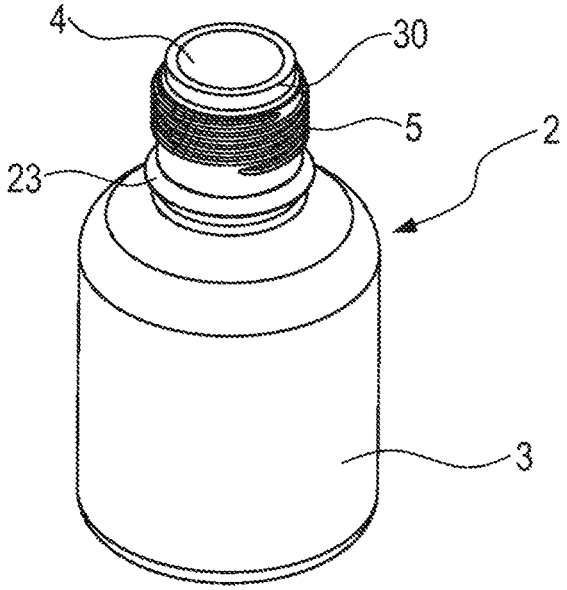
FIG. 1 is a perspective view of a first container of a packaging system according to a first embodiment of the invention.

FIG. 1 shows a first container 2 which, in the shown embodiment, is designed as a glass bottle and is part of a packaging system. Alternatively, it could also be made of plastics material, for example. The packaging system, which is explained in more detail with reference to the following drawings, is used to accommodate a multi-component product preparation, with individual components being kept separate before the product is used. For this purpose, the packaging system has the first container 2 shown in FIG. 1, in which at least one first component of the product preparation is stored. The first container 2 has a body 3 and a neck 30 which opens into an opening 4 of the container 2. A thread 5 designed as an external thread is also arranged in the region of the neck 30, as well as a locking ring 23 which is designed as a circumferential projection on the neck 30.

Figure 2A:
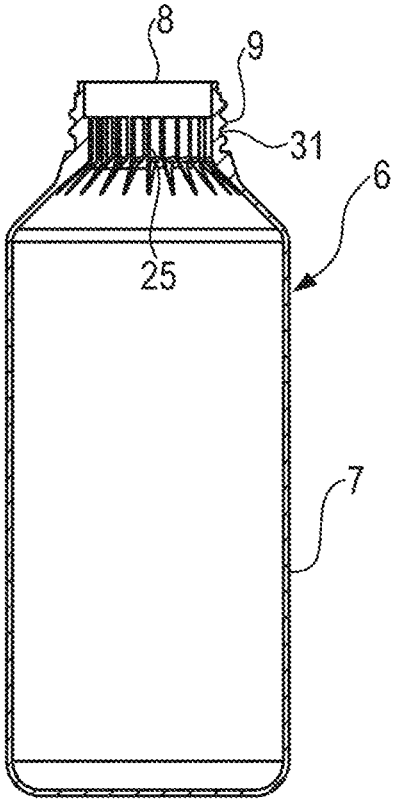
FIG. 2*a* is a sectional view of a second container of the packaging system according to the first embodiment of the invention.
Figure 2B:
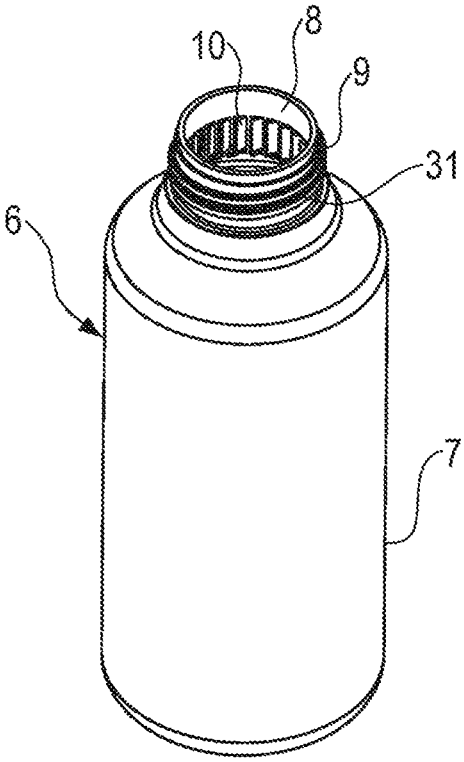
FIG. 2*b* is a perspective view of the container according to FIG. 2*a;*

FIGS. 2*a* and 2*b* are a sectional view and a perspective view of a second container 6 which, together with the first container 2 according to FIG. 1 and a closure element described in the following figures, constitutes a packaging system. The second container 6 is used to store at least one further component of the product preparation and also to mix the components from the first container 2 and the second container 6 and to store the ready-to-use product.

The second container 6 also has a body 7 and a neck 31 which opens into an opening 8. The second container 6 is typically also made of plastics material or glass.

The packaging system can be, for example, the packaging of a hair dye which is mixed from at least two components immediately before use.

A thread 9 designed as an external thread is also arranged in the region of the neck 31 of the second container 6. Furthermore, a locking ring 10 consisting of a plurality of receiving portions for locking teeth is arranged on the inside of the neck 31, In the embodiment shown, the second container 6 has a greater volume than the first container 2.

FIGS. 3*a* to 3*f* are different views of a closure element 11 which initially is used to close the first container 2 and then is used to connect the first container 2 to the second container 6.

Figure 3A:
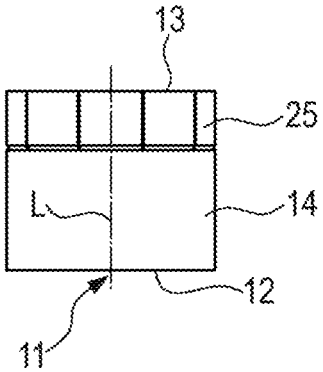
FIGS. 3*a* to 3*f* are different views of a closure element for the packaging system according to the first embodiment.

FIG. 3*a* is a side view of the closure element 11. Said closure element has a first opening 12 on one side and a second opening 13 on the opposite side. The first opening 12 is provided for connection to the opening 4 of the first container 2. The second opening 13 is provided for connection to the opening 8 of the second container 6. Furthermore, the closure element 11 has a wall 14 which is in the form of a cylinder jacket. The closure element 11 has a longitudinal axis L which, in the shown embodiment, can coincide with the longitudinal axes of the containers 2, 6. Around the second opening 13, the edge region is designed as a tamper-evident ring 25, the function of which is explained in more detail below.

Figure 3B:
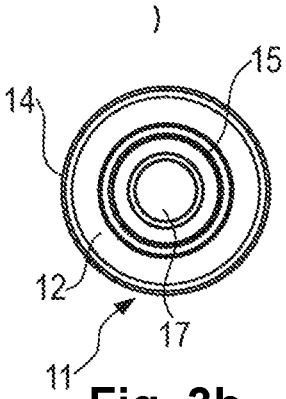

FIG. 3*b* is a view of the closure element 11 from a perspective directed into the first opening 12. In this view, as in the perspective view according to FIG. 3*e*, it can be seen that a thread 15 designed as an internal thread is arranged in the interior of the closure element 11, as well as a circumferential locking groove 22. The thread 15 is designed as a thread corresponding to the thread 5 of the first container 2. The locking groove 22 is provided to receive the locking ring 23 of the first container 2.

Figure 3C:
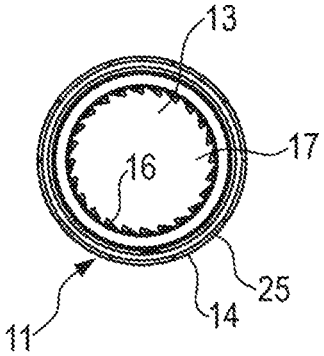
Figure 3D:
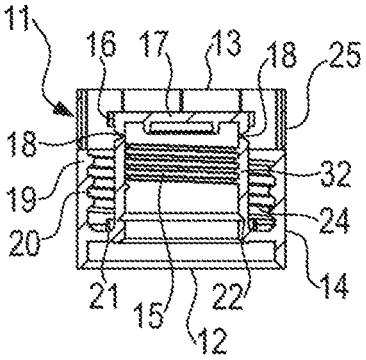
Figure 3E:
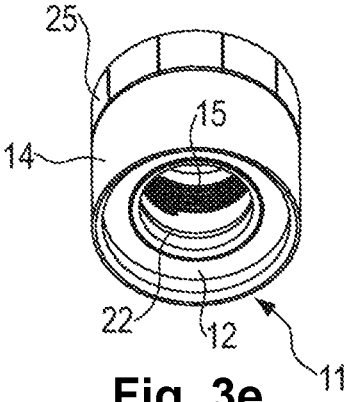
Figure 3F:
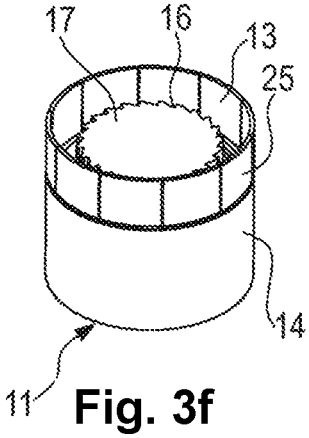

FIGS. 3*c* and 3*f* show a view of the closure element 11 with a viewing direction into the second opening 13. In this view it can be seen that the closure element 11 comprises a closure cap 17 which closes a flow path from the first opening 12 to the second opening 13. The edge of the closure cap 17 is designed as a locking ring 16 having a large number of locking teeth. The locking teeth are provided for engaging in the locking ring 10 on the inside of the second container 6.

In the sectional view in FIG. 3*d*, it can be seen that the closure cap 17 is connected to the rest of the closure element 11 via a predetermined breaking point 18 which is designed as a circumferential region having a small material thickness.

In the sectional view in FIG. 3*d*, it can also be seen that the wall 14 of the closure element 11 is designed as a collar 19 which coaxially surrounds a second wall 32. The thread 15 is arranged on the inside of the second wall 32. A thread 20 which is designed as an internal thread is also arranged on the inside of the first wall 14. An intermediate space 24 is formed between the first wall 14 and the second wall 32. A seal 21 is formed in said intermediate space 24 as a circumferential sealing lip which, when in use, is intended to seal off the second container 6 from the surroundings in a fluid-tight manner.

Figure 4:
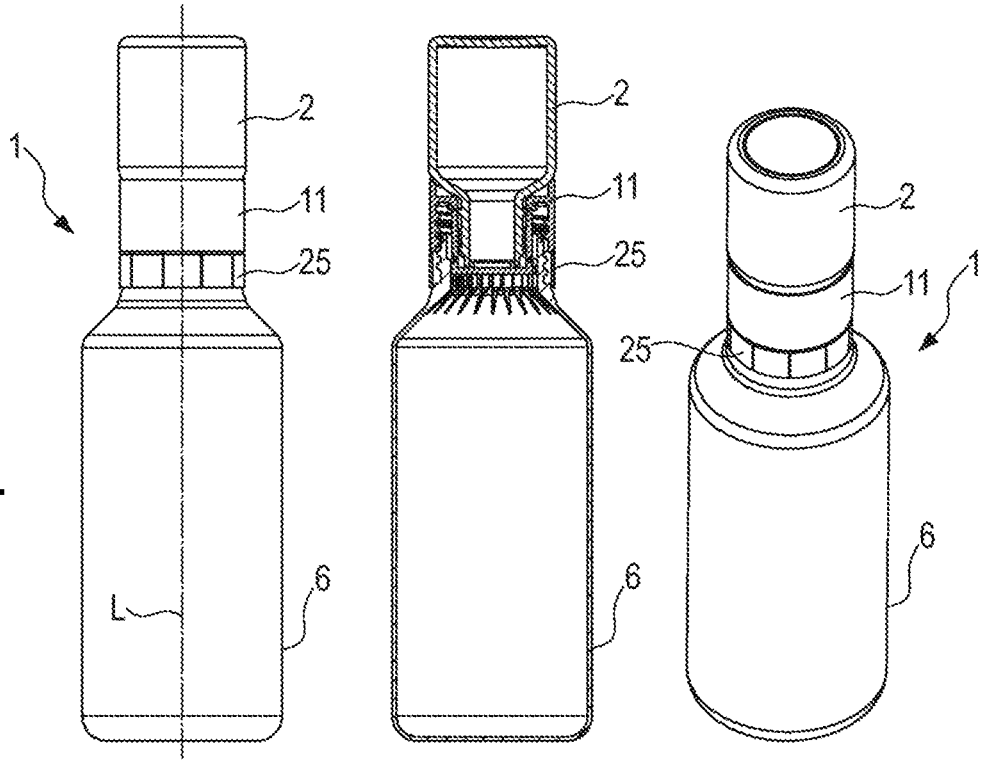
FIG. 4 shows different views of the packaging system according to the first embodiment in a first position.

FIG. 4 shows different views of the closure system 1 having the first container 2, the second container 6 and the closure element 11 which connects the first container to the second container 6.

The closure element 11 is connected to the first container 2 via the threads 5, 15 and via the locking connection consisting of the locking groove 22 and locking ring 23. As a result of the embodiment of the locking connection, which is shown in detail in FIG. 5, once the closure element 11 has been placed on, it can only be removed from the first container 2 by force and optionally with the destruction of the closure element 11. The closure element 11 seals off the first container 2 from the surroundings. The first container 2 closed by the closure element 11 can therefore also be suitable for longer storage of a first component of a product preparation. In addition, the first container 2, which is non-detachably closed by the closure element 11, can be safely handled and is therefore also suitable for storing dangerous substances.

In order to mix a ready-to-use product preparation, a closure (not shown in the drawings) is removed from the second container 6; said closure is in particular originally connected to the second container 6 via the thread 9 and is unscrewed therefrom before preparation. The first container 2 closed by the closure element 11 is then placed upside-down on the second container 6, and the closure element 11 is connected to the second container 6.

In the first embodiment shown in FIGS. 1 to 9, the closure element 11 is connected to the second container 6 by means of the thread 20, which interacts with the thread 9 of the second container 6. The closure element 11 connected to the first container 2 is thus screwed onto the second container 6.

Figure 5:
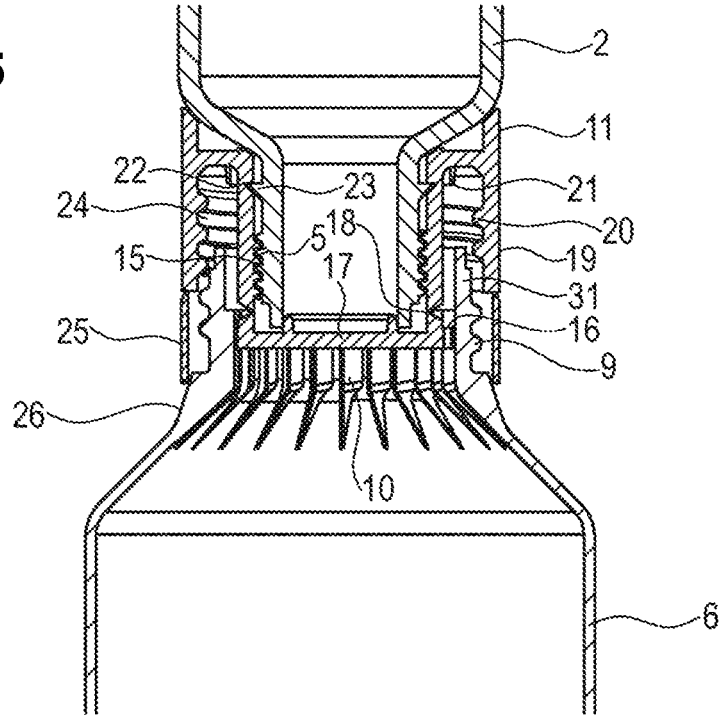
FIG. 5 shows a detail of FIG. 4.

In FIG. 4, the packaging system 1 is shown in a first position, specifically immediately after the first container 2 having the closure cap 11 has been placed on the second container 6, and thus at the beginning of the screwing process. As can be seen in FIG. 5, the threads 9 and 20 do not yet engage in one another at this point in time. However, the collar 19 of the closure element 11 already projects beyond the neck 31 of the second container 6. In addition, locking ring 16 already engages in locking ring 10 and thus fixes the closure cap 17 to the second container 6 so as to be secured against rotation.

In this position, the tamper-evident ring 25 projects down to an obliquely extending flank 26 of the neck 31 of the second container 6. The flank 26, which has an obliquely outwardly directed profile, is used to destroy the tamper-evident ring 25 when the two containers 2, 6 are connected, as described below. In the first position shown in FIGS. 4 and 5, however, the tamper-evident ring 25 is still intact.

Figure 6:
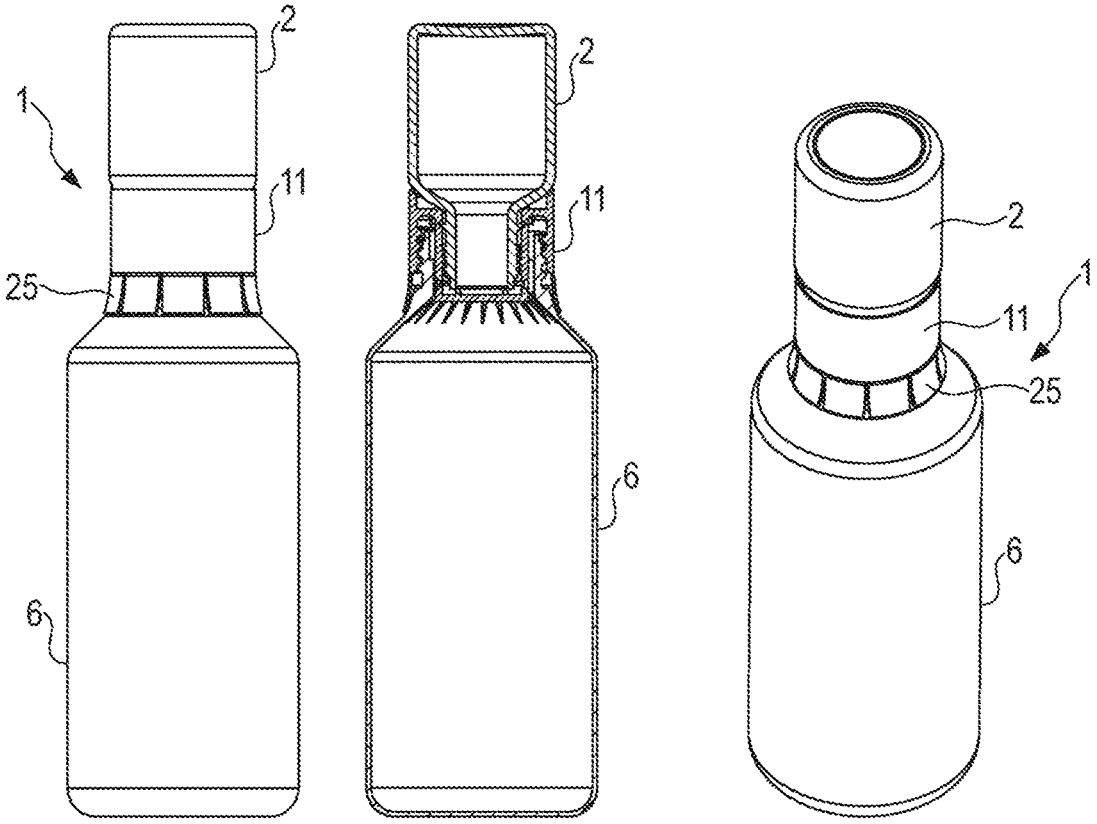
FIG. 6 shows different views of the packaging system according to FIG. 4 in a second position.
Figure 7:
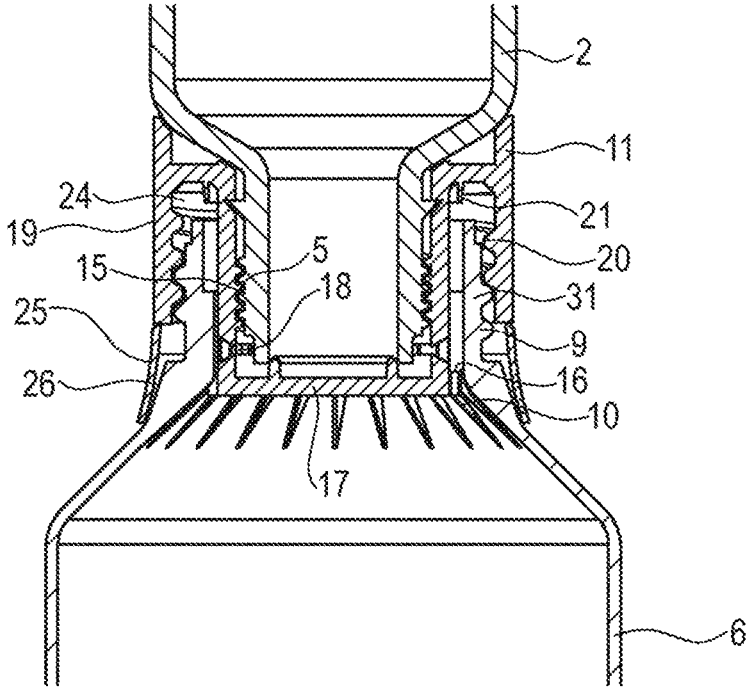
FIG. 7 shows a detail of FIG. 6.

FIGS. 6 and 7 show the packaging system 1 in a second position which differs from the position shown in FIGS. 4 and 5 in that the closure element 11 has already been screwed to the second container 6. As can be seen in particular in FIG. 7, the threads 9, 20 now engage in one another and the neck 31 of the second container 6 projects further into the intermediate space 24 than in the first position according to FIG. 5. Furthermore, the tamper-evident ring 25 has already been partially destroyed by contact with the flank 26.

As can be seen in FIG. 7, the closure cap 17 fixed relative to the second container 6 has also been separated from the closure element 11 along the predetermined breaking point 18 by the rotation of the closure element 11 relative to the second container 6 when screwing the closure element 11 onto the second container 6. In the second position shown in FIGS. 6 and 7, the closure cap 17 is still inserted in the neck 31 of the second container 6 and locking ring 16 is in engagement with locking ring 10.

Figure 8:
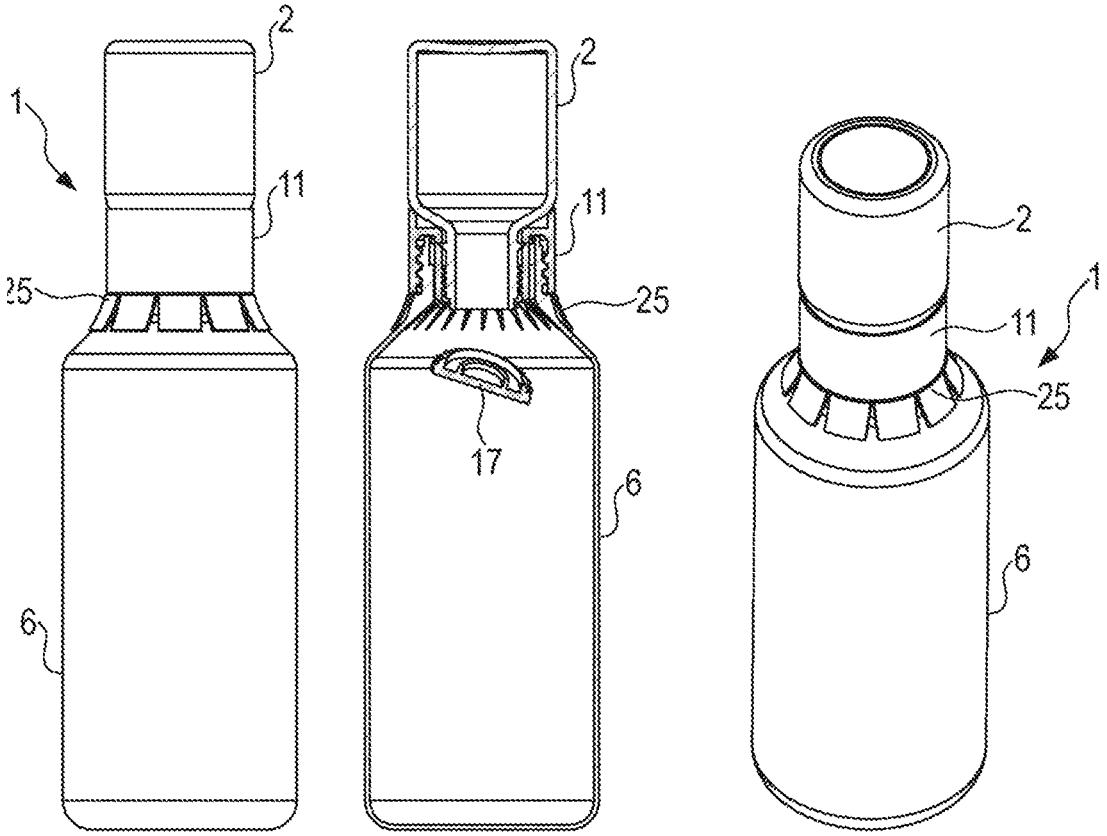
FIG. 8 shows different views of the packaging system according to FIGS. 4 and 6 in a third position.
Figure 9:
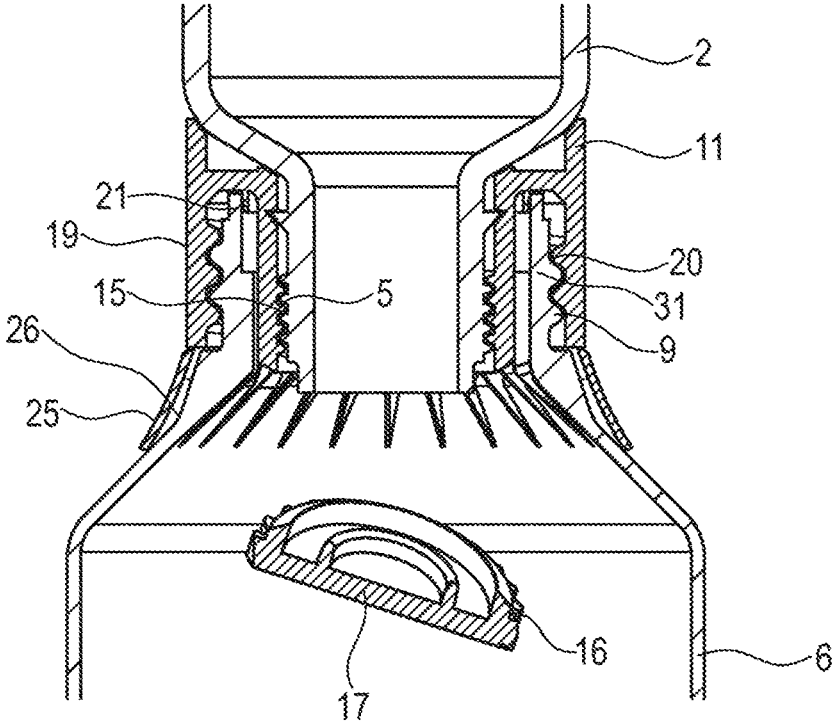
FIG. 9 shows a detail of FIG. 8.

FIGS. 8 and 9 show the packaging system 1 in a third position which differs from the second position shown in FIGS. 6 and 7 in that the closure element 11 has been screwed a little further onto the second container 6. As can be seen in FIG. 9, in this end position, the uppermost edge of the neck 31 of the second container 6 is in contact with the seal 21 on the inside of said edge, such that the second container 6 is sealingly connected to the closure element 11. The closure cap 17, which was already separated in the second position, has been pressed into the second container 6 by the further screwing of the closure element 11 onto the second container 6 and thus has released a fluidic connection between the first container 2 and the second container 6.

In the third position shown in FIGS. 8 and 9, the tamper-evident ring 25 has also been further destroyed by contact with the inclined flank 26 and thus now indicates an opening of the fluidic connection between the first container 2 and the second container 6. The fluids stored in the first container 2 and the second container 6 can now be mixed with one another using the fluidic connection created by the separation of the closure cap 17.

The emptied first container 2 having the closure element 11 seated thereon can then be unscrewed from the second container 6 and disposed of. The finished product preparation is now available in the second container 6 for further use. An applicator can optionally be placed on the second container 6 for further use; said applicator can in particular be screwed onto the second container 6 using the thread 9.

Figure 10:
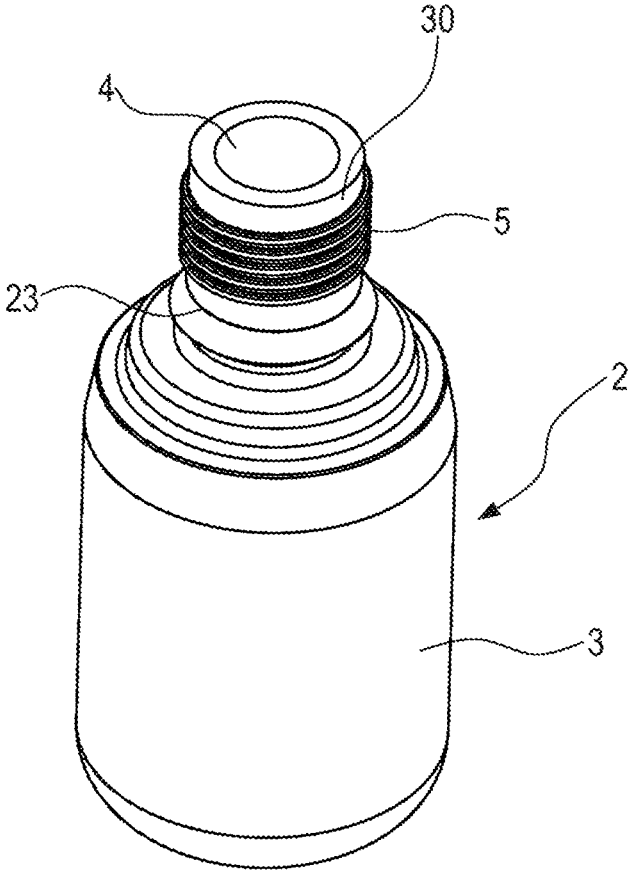
FIG. 10 shows a first container of a packaging system according to a second embodiment of the invention.

FIG. 10 shows a first container 2 of a second embodiment of a packaging system. The first container 2 according to the second embodiment, like the container shown in FIG. 1, has a body 3 and a neck 30 which opens into an opening 4 of the container 2. A thread 5 designed as an external thread is also arranged in the region of the neck 30, as well as a locking ring 23 which is designed as a circumferential projection on the neck 30.

FIG. 11 shows two different, mutually perpendicular sectional views of a second container 6 according to the second embodiment, which, together with the first container 2 according to FIG. 10 and a closure element described in the following figures, constitutes a packaging system. The second container 6 also has a body 7 and a neck 31 which opens into an opening 8. A thread 9 designed as an external thread is also arranged in the region of the neck 31 of the second container 6.

In addition, the second container 6 has opposing grooves on the inside of the neck 31 thereof, which, together with projections on the closure element, as explained below, constitute corresponding coupling elements which allow a relative rotation of the closure element and the second container 6 in a value range of less than 180°.

FIGS. 13*a* to 13*f* are different views of a closure element 11 according to the second embodiment that initially is used to close the first container 2 and then is used to connect the first container 2 to the second container 6.

FIG. 13*a* is a side view of the closure element 11. Said closure element has a first opening 12 on one side and a second opening 13 on the opposite side. The first opening 12 is provided for connection to the opening 4 of the first container 2. The second opening 13 is provided for connection to the opening 8 of the second container 6. Furthermore, the closure element 11 has a wall 14 which is in the form of a cylinder jacket.

The closure element 11 has a closure cap 17 which is connected to the rest of the closure element 11 via a circumferential predetermined breaking point 18.

Furthermore, the closure element has opposing projections 28 both in the region of the closure cap 17 and below it in the region of the wall 14, which projections interact with the grooves 27 of the second container 6.

FIG. 13*b* is a view of the closure element 11 from a perspective directed into the first opening 12. In this view, as in the perspective view according to FIG. 3*e*, it can be seen that a thread 15 designed as an internal thread is arranged in the interior of the closure element 11, as well as a circumferential locking groove 22. The thread 15 is designed as a thread corresponding to the thread 5 of the first container 2. The locking groove 22 is provided to receive the locking ring 23 of the first container 2.

FIGS. 3*c* and 3*e* show a view of the closure element 11 with a viewing direction into the second opening 13. In this view it can be seen that the closure element 11 comprises a closure cap 17 which closes a flow path from the first opening 12 to the second opening 13.

Figure 13D:
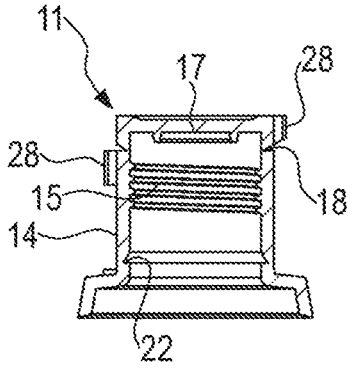
Figure 13E:
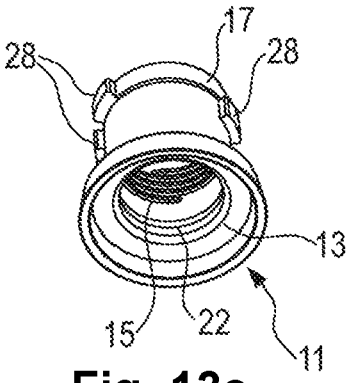
Figure 13F:
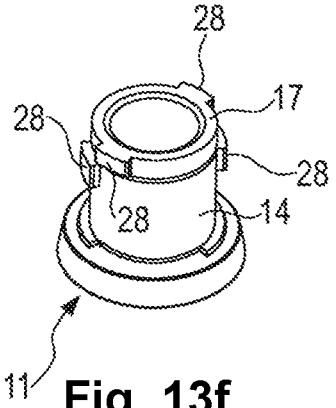

As can be seen in particular in FIG. 13*f*, the projections 28 on the closure cap 17 are arranged so as to be rotated by a few degrees with respect to the projections 28 on the wall 14. An identical projection 28 lies exactly opposite each projection 28, such that two opposing projections 28 are arranged on the closure cap 17 and on the wall 14 in each case.

Figure 14:
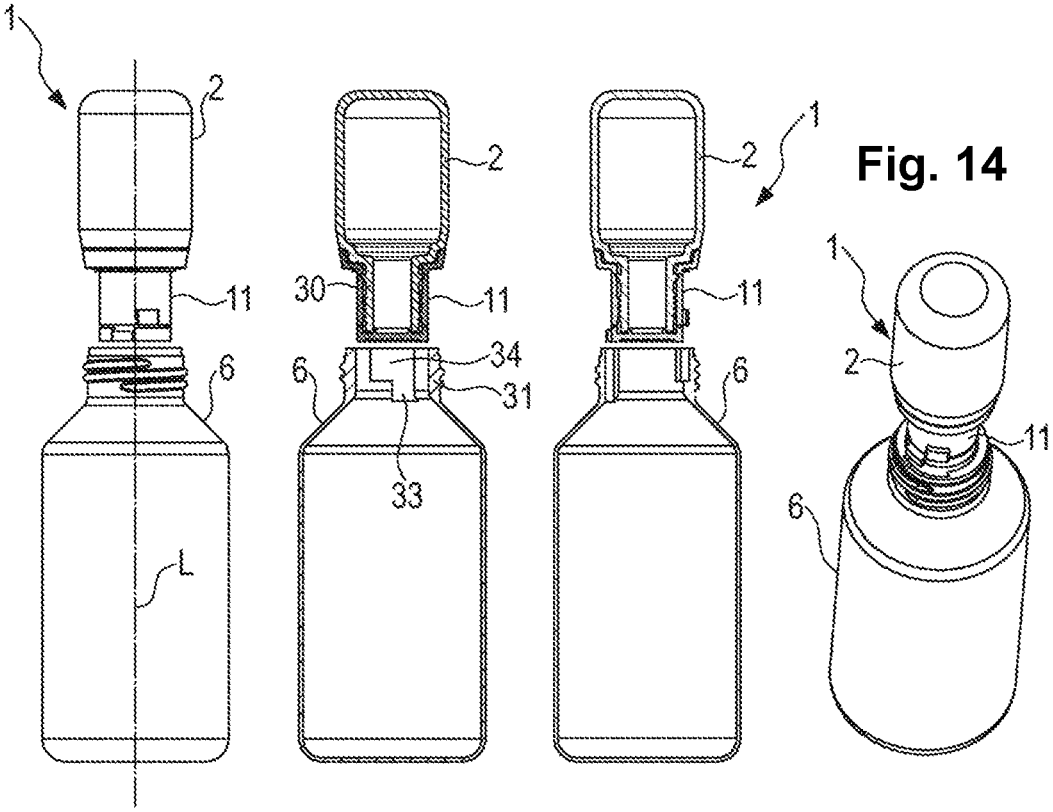
FIG. 14 shows different views of the packaging system according to the second embodiment in a first position.
Figure 15:
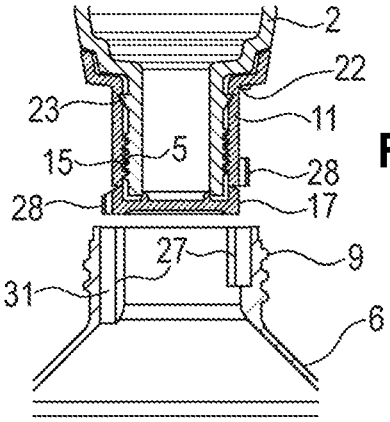
FIG. 15 shows a detail of FIG. 14.

In FIGS. 14 and 15, the packaging system 1 is shown in a first position, specifically immediately before the first container 2 having the closure cap 11 is placed on the second container 6. As can be seen in FIG. 15, the closure element 11 has not yet been inserted into the neck 31 of the second container 6.

Figure 16:
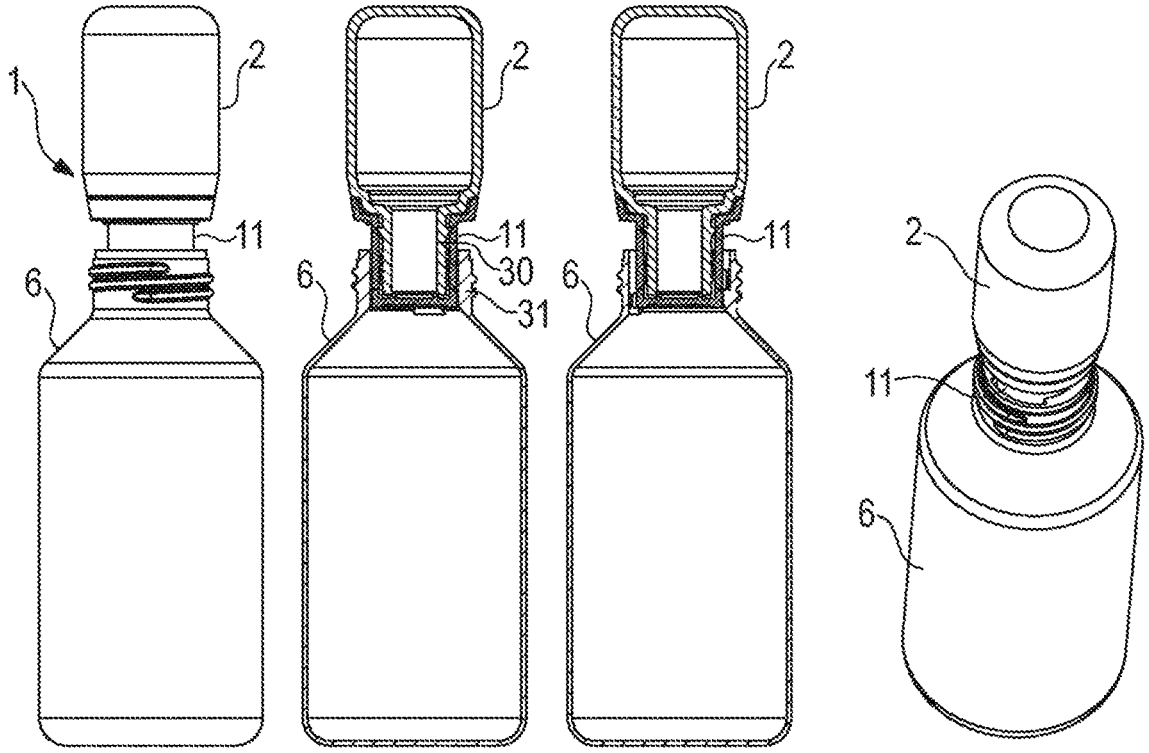
FIG. 16 shows different views of the packaging system according to FIG. 14 in a second position.

FIG. 16 shows the packaging system 1 in a second position, in which the neck 30 of the first container 2, which is provided with the closure element 11, has been inserted into the neck 31 of the second container 6 in order to connect the containers 2, 6 to one another. For this purpose, the first container 2 and the second container 6 are rotated with respect to one another in such a way that the projections 28 on the closure cap 17 protrude into the grooves 27 on the neck 31 of the second container 6. The grooves 27 have a type of L-shape which allows the projections 28 on the closure cap 17 to penetrate into the second container 6 as far as the lower end of the neck 31. In this position shown in FIG. 16, the projections 28 on the closure cap 17 then come to rest in the lower region of the grooves 27, which is denoted by reference sign 33 in FIG. 14. Since this lower region 33 has approximately the same dimensions as the projections 28 on the closure cap 17, in this second position the closure cap 17 is fixed to the second container 6 so as to be secured against rotation. Since an upper region 34 of the grooves 27 has a greater angular extension, the rest of the closure element 11 can be rotated with respect to the second container 6 in an angular range which results from the angular extension of the upper region 34 relative to the dimensions of the projections 28 on the wall 14.

Figure 17:
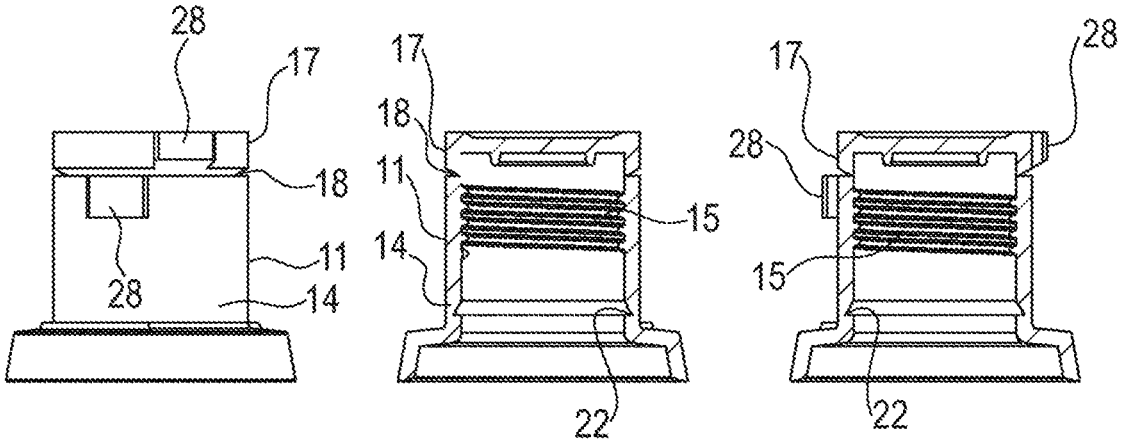
FIG. 17 shows different views of the closure element according to the second embodiment of the invention in a first state.

FIG. 17 shows the closure element 11 in a plurality of views in an undamaged state, it being possible to see that the projections 28 on the closure cap 17 are arranged so as to be rotated with respect to the projections 28 on the wall 14. It can also be seen in FIG. 17 that the closure cap 17 is separated from the rest of the closure element 11 by a circumferential predetermined breaking point 18.

Figure 18:
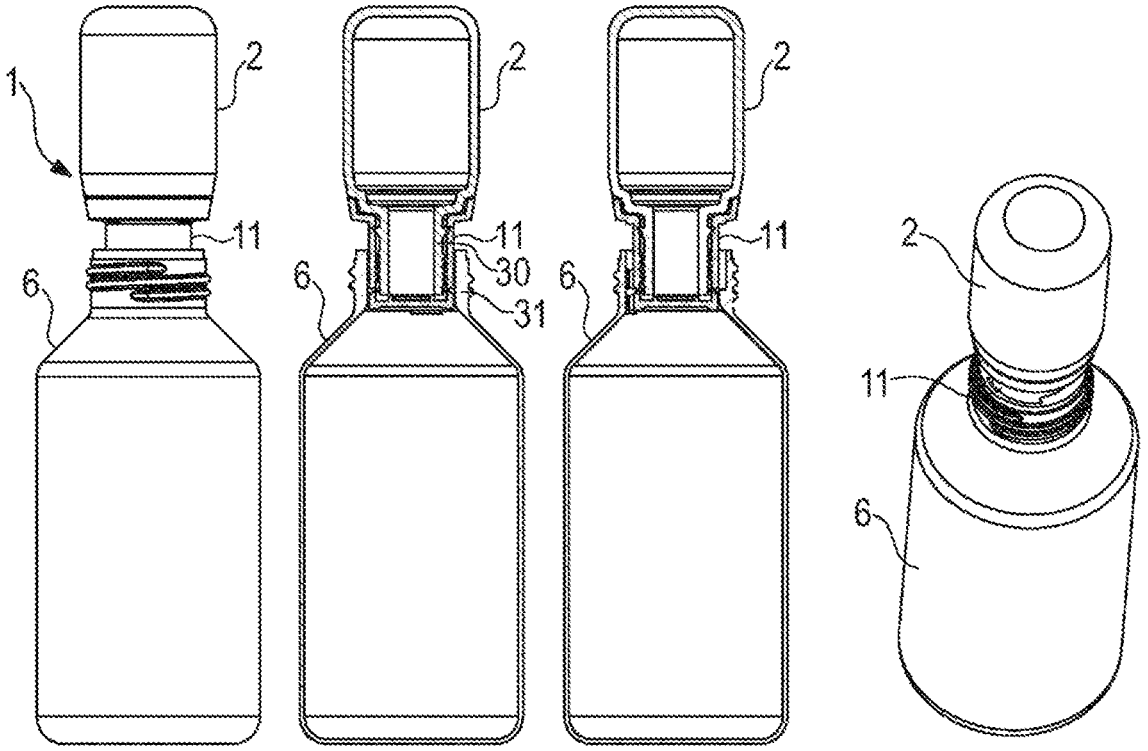
FIG. 18 shows different views of the packaging system according to FIGS. 14 and 16 in a third position.

FIG. 18 shows the packaging system 1 in a third position, in which the closure cap 17 has been separated by rotating the first container 2 provided with the closure element 11 with respect to the second container 6. For this purpose, the first container 2 having the closure element 11 has been rotated with respect to the second container 6 as far as the freedom of movement of the projections 28 on the wall 14 in the upper region 34 of the grooves 27 allows. Since the closure cap 10 was fixed to the second container 6 so as to be secured against rotation, it could not rotate therewith, and the closure cap 17 was separated by breaking at the predetermined breaking point 18.

Figure 19:
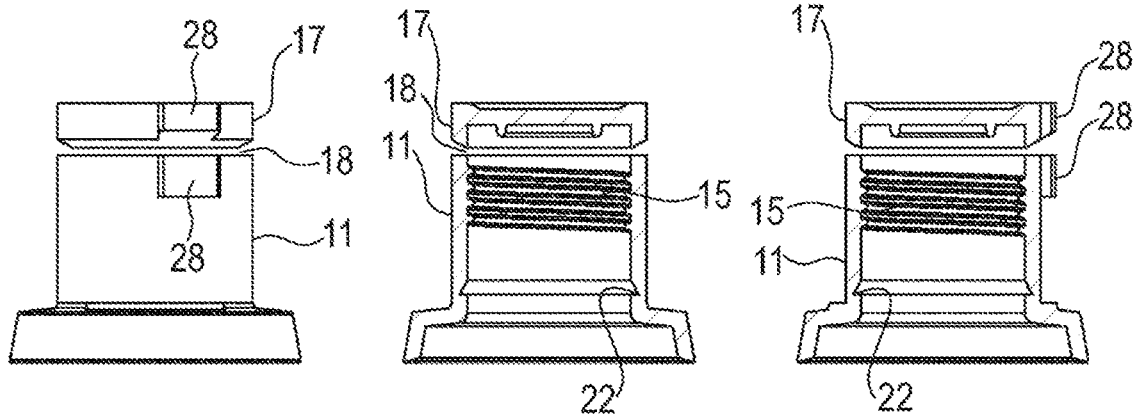
FIG. 19 shows different views of the closure element in a second state.

As can be seen in FIG. 19, the closure element 11 is now in a state in which the closure cap 17 is separated from the rest of the closure element 11 and in which the projections 28 are also positioned above one another in a line.

Since the projections 28 are now aligned in this way, it is possible to press the first container 2, which is provided with the closure element 11, even further into the neck 31 of the second container 6, since the projections 28 on the wall 14 now can also pass through the lower region 33 of the grooves 27.

Figure 20:
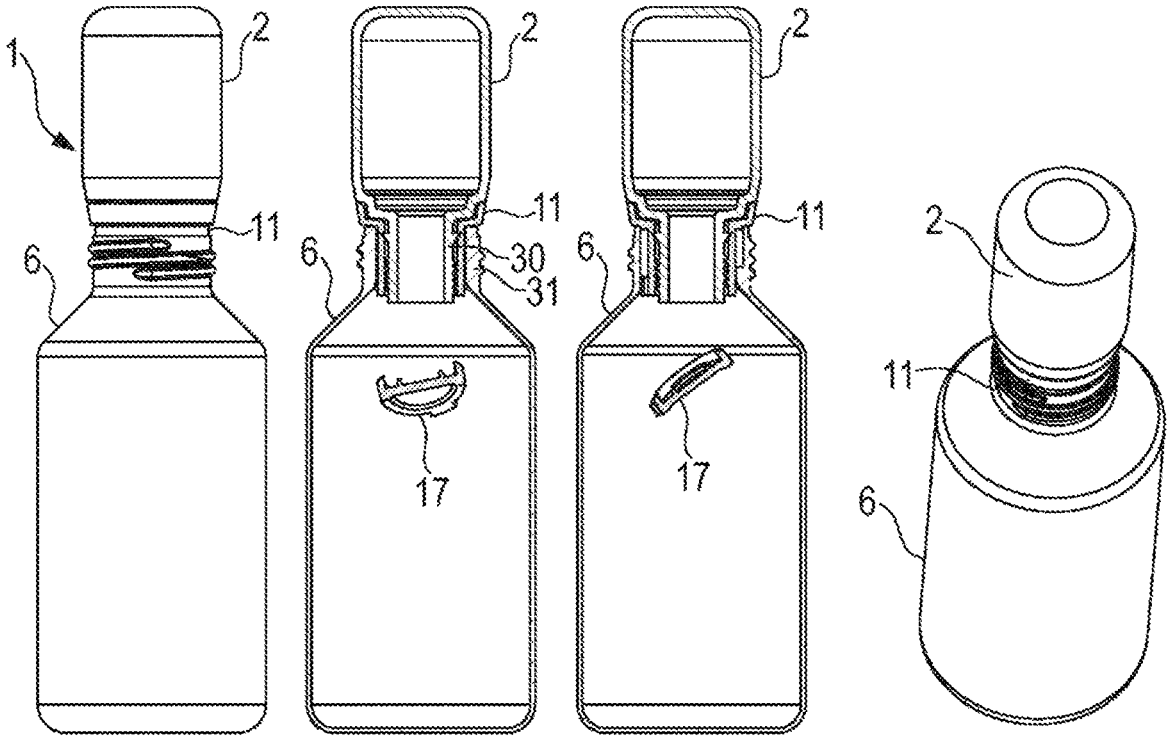
FIG. 20 shows different views of the packaging system according to FIGS. 14, 16 and 18 in a fourth position.

FIG. 20 shows the packaging system 1 in a fourth position, in which the first container 2 provided with the closure element 11 has been pressed so far into the second container 6 that the separated closure cap 17 falls into the second container 6.

The product preparation components can then be mixed using the fluidic connection that has now been produced between the containers 2, 6.

LIST OF REFERENCE SIGNS

1 packaging system
2 first container
3 body

4 opening
5 thread
6 second container
7 body
8 opening
9 thread
10 locking ring
11 closure element
12 first opening
13 second opening
14 wall
15 thread
16 locking ring
17 closure cap
predetermined breaking
18 point
19 collar
20 thread
21 seal
22 locking groove
23 locking ring
24 intermediate space
25 tamper-evident ring
26 flank
27 groove
28 projection
30 neck
31 neck
32 wall
33 lower region
34 upper region
L axis

What is claimed is:

1. A packaging system for preparation of a multi-component product, the packaging system comprising:

a first container configured to store a first product preparation component;

a second container configured to store at least one second product preparation component; and a closure element comprising a coupling device connected to a closure cap, the closure cap being configured to seal the first container, the coupling device being configured to couple to the second container, and the closure element being configured to establish a fluid connection between the first container and the second container when the closure cap is separated from the closure element, wherein the closure cap is configured to be completely separated from the closure element along a predetermined breaking point, a material thickness of the predetermined breaking point being greater than zero, and wherein the closure cap is configured to directly engage an inner surface of the second container to rotationally lock the closure cap relative to the second container, and the closure cap is axially movable relative to the second container such that the closure cap falls into the second container when the closure cap is completely separated from the closure element.

2. The packaging system of claim 1, wherein the closure element is connected to the first container in a non-detachable manner, excluding by the destruction of the closure element.

3. The packaging system of claim 1, wherein the closure element is locked to the first container in a non-detachable manner.

4. The packaging system of claim 1, wherein the closure element and the second container have corresponding threaded portions used to couple the closure element to the second container, to the closure element by screwing.

5. The packaging system of claim 1, wherein the coupling device has an internal thread that interacts with an external thread of the second container to couple the coupling device to the second container.

6. The packaging system of claim 1, wherein the closure element and the second container have corresponding coupling elements that limit relative rotation of the closure element and the second container to less than 180°.

7. The packaging system of claim 1, wherein the closure cap has at least one projection configured to interact with at least one corresponding recess in the inner surface of the second container to rotationally lock the closure cap relative to the second container.

8. The packaging system of claim 1, wherein the closure cap is covered with a cover element to prevent manual access to the closure cap.

9. The packaging system of claim 8, wherein the cover element radially surrounds the closure cap and projects axially beyond the closure cap.

10. The packaging system of claim 9, wherein the cover element comprises a tamper-evident ring configured to break into a plurality of portions when the closure cap is separated from the coupling device.

11. The packaging system of claim 1, wherein the coupling device is coupled to the second container in a liquid-tight manner.

12. The packaging system of claim 1, wherein the closure element has at least one seal to ensure a liquid-tight connection to the first container and/or the second container.

13. A method for mixing a multi-component product preparation using the packaging system of claim 1, the method comprising:

attaching the first container to the second container using the closure element by screwing the coupling device to the second container and coupling the closure cap to the second container to be rotationally locked relative to the second container;

further screwing the coupling device to the second container to completely separate the closure cap from the closure element at the predetermined breaking point and cause the closure cap to fall into the second container, thereby establishing the fluid connection between the first container and the second container; and mixing the first product preparation component and the at least one second product preparation component.

14. A method for mixing a multi-component product preparation using the packaging system of claim 1, the method comprising:

attaching the first container to the second container using the closure element by coupling the coupling device to the second container and coupling the closure cap to the second container to be rotationally locked relative to the second container;

rotating the coupling device relative to the second container to completely separate the closure cap from the closure element at the predetermined breaking point and cause the closure cap to fall into the second container, thereby establishing the fluid connection between the first container and the second container; and mixing the first product preparation component and the at least one second product preparation component.

15. The packaging system of claim 10, wherein the plurality of portions, upon engagement with an inclined flank of the second container, flair radially outward.

16. The packaging system of claim 1, wherein the closure cap comprises radial locking teeth, and the inner surface of the second container has a locking ring that engages with the radial locking teeth to rotationally lock the closure cap to the second container.

17. The packaging system of claim 1, wherein the closure cap comprises projections, and the inner surface of the second container has grooves that interact with the projections to rotationally lock the closure cap to the second container.

18. The packaging system of claim 17, wherein the grooves the inner surface of the second container are L-shaped.

19. The packaging system of claim 1, wherein the predetermined breaking point is circumferentially defined around the closure cap.

20. The packaging system of claim 1, wherein the material thickness of the predetermined breaking point is less a material thickness of the closure cap and a material thickness of the closure element adjacent the predetermined breaking point.

* * * * *